United States Patent [19]

Völkel et al.

[11] Patent Number: 4,546,683

[45] Date of Patent: Oct. 15, 1985

[54] METHOD OF AND A CUTTING PRESS FOR SEPARATING PARTS FROM A WORKPIECE PLATE

[75] Inventors: Elmar Völkel, Kreiensen; Walter Bredow, Alfeld, both of Fed. Rep. of Germany

[73] Assignee: Behrens AG, Alfeld, Fed. Rep. of Germany

[21] Appl. No.: 576,527

[22] Filed: Feb. 2, 1984

[30] Foreign Application Priority Data

Mar. 30, 1983 [DE] Fed. Rep. of Germany ..... 3311593

[51] Int. Cl.[4] ..... B30B 9/00

[52] U.S. Cl. ..... 83/27; 83/49; 83/103; 83/157; 83/405; 83/563; 83/552

[58] Field of Search ..... 83/25, 27, 49, 103, 83/104, 108, 157, 405, 563, 255, 256, 552

[56] References Cited

U.S. PATENT DOCUMENTS 2,167,734 8/1939 Zonino ..... 83/103 X 3,383,065 5/1968 Bergeron et al. ..... 83/108 X

*Primary Examiner*—James M. Meister

*Attorney, Agent, or Firm*—Michael J. Striker

[57] ABSTRACT

Parts which cannot fall because of their dimensions through an opening of a lower tool are separated from a workpiece plate in a cutting press with an immovable support, a coordinate table, two lateral workpiece supports movable parallel to the y-axis and a transverse carriage displaceable in the direction of the x-axis and having clamping elements, and with a central workpiece support of a plurality of articulately connected supporting elements displaceable in the direction of the y-axis so that a discharge opening for the separated part of the workpiece plate is openable or closable, in such a manner that first a cutting tool separates a workpiece part so as to retain at least one connecting web between separating edges of the workpiece plate and the workpiece part located transverse to the direction of movement of the central workpiece support, the workpiece plate and workpiece support being positioned by the coordinate table above the discharge opening, and before opening of the discharge opening the connecting web is removed by displacement of the central workpiece support from the workpiece plate with the aid of a special separating device on the cutting press.

9 Claims, 12 Drawing Figures

17
16
18
42
32
17a
20a
31
20
20
30
34
38
20a
30a
37
37a
1
37b
36
35
62
61
Y
41

METHOD OF AND A CUTTING PRESS FOR SEPARATING PARTS FROM A WORKPIECE PLATE

BACKGROUND OF THE INVENTION

The present invention relates to a method of and a cutting press for separating such parts from a workpiece plate which because of their dimensions cannot fall through an opening in a lower tool.

It is known to separate parts on a cutting press which has an immovable support surrounding the operating region of the tool, a controlled coordinate table for positioning of a workpiece and having two lateral workpiece supports movable parallel to the y-axis and defining a space therebetween for the movable support, and a guiding rail connecting the lateral workpiece supports and having a transverse carriage displaceable in the direction of the x-axis and having clamping elements for the workpiece plate, and a central workpiece support located between the lateral workpiece supports before the immovable support and including a plurality of articulately connected supporting elements. The supporting elements are supported and guided relatively movable in guide paths arranged on the lateral workpiece supports and displaceable therewith with the path course directed downwardly in the region of the clamping elements of the transverse carriage. The supporting elements are pulled back by special pulling means in the direction of the y-axis from the immovable support so that between the immovable support and the first supporting element facing thereto a discharge opening for the separated parts of the previously withdrawn workpiece plate is opened and by the respective return movement of the supporting elements is closed. A cutting press, especially a revolving cutting press of the above mentioned type is disclosed in U.S. patent application Ser. No. 405,336, now U.S. Pat. No. 4,452,115. The discharge openings formed by the displaceable central workpiece support provides for a possibility to withdraw the cut out or separated parts of the workpiece plate not through the opening of the lower tool because of their dimensions, but to withdraw them automatically without distortion of other machine steps through the discharge opening.

It has been shown from practice that during the operation of such a cutting press there are difficulties when relatively thin workpiece plates or sheets are worked. These difficulties include the following: The cut out workpiece parts must be withdrawn with the remaining workpiece plate from the tool operating region, and the coordinate table must displace in the direction of the y-axis to bring the cut out workpiece part for discharge on the central workpiece support so as to discharge this workpiece part after release of the discharge opening. It has been shown that during working of relatively thin workpiece plates or sheets the cut out workpiece part and the remaining workpiece plate move over one another, whereby a safe fall or withdrawal of the cut out workpiece parts through the discharge opening is hampered or made completely impossible.

SUMMARY OF THE INVENTION

Accordingly, it is an object of the present invention to provide a method of and a cutting press for cutting or separating parts of a workpiece plate which avoid the disadvantages of the prior art.

More particularly, it is an object of the present invention to provide a method of and a cutting press for separating or cutting parts of a workpiece plate, in accordance with which these difficulties are reliably eliminated and an unobjectionable undisturbed discharge of the cut out workpiece parts through the discharge opening is provided, without affecting other machine steps.

In keeping with these objects and with others which will become apparent hereinafter, one feature of the present invention resides, briefly stated, in that with the aid of the respective cutting tool first a workpiece part is separated from a workpiece plate so as to retain at least one connecting web between the edges of the workpiece part and the workpiece plate, the edges extending transverse to the direction of movement of the central workpiece support, and the connecting web or the connecting webs after position of the workpiece plate and the workpiece part by the coordinate table above the discharge opening and prior to opening, are separated by displacement of the central workpiece support from the workpiece part.

In this case first after initial separating step the workpiece plate and the workpiece part remain still connected by the connecting web and can be displaced together, and therefore the connecting web prevents the above described disadvantegeous displacement of the workpiece part and the workpiece plate over one another. When the desired positioning of the workpiece part above the discharge opening is attained, the connecting web is separated and the workpiece part after opening of the discharging opening can be discharged.

Depending upon the contour and dimensions of the workpiece part, one or several connecting webs can be provided on the separating edges extending transverse to the movement direction of the central workpiece support. The separating steps can be conducted and controlled during the remaining machine cycle by simple means. This makes possible a reliable taking along of the workpiece part with the cut out connecting webs. Depending upon whether one part or both parts are usable parts, the connecting web can be separated from one usable part or from both usable parts.

In accordance with another feature of the present invention, the separating step is conducted so that one or several connecting webs are formed between those edges of the workpiece plate and the workpiece part which face toward the central workpiece support. This provides for the advantage that during displacement of the workpiece plate with the workpiece part to their position above the discharge opening to be opened, a pulling force is applied exclusively on the connecting web, which reliably provides for the undisturbed displacement of the workpiece plate and via the connecting piece, of the workpiece part connected therewith.

For carrying out the above described inventive method, a cutting press is provided in accordance with the present invention which is equipped with a special separating device arranged on the cutting press in correspondence with the positioning of the connecting web in its separating position. The separating device or the separating devices are selected in correspondence with the number and location of the connecting webs, and arranged on the machine so as to be associated with and actuated by the respective working and control steps of the machine.

When the workpiece plates or sheets with especially small thickness and low strength are to be worked, an especially simple embodiment of the invention can be provided when at least one separating arrangement is arranged on a machine part located above the tool operating region and above the support surrounding the tool separating region, so that the immovable support is formed as an abutment or a lower tool for the separating element of the separating device. A simple chisel-like tool can be used here so as to act in the respective position directly on the support which absorbs the reaction force. For simple structural arrangement of the separating device or the separating devices on the machine body, the separating web can be provided between the separating edges facing toward the working region so that after a short displacement movement of the workpiece plate with the workpiece part, the final separating step for the connecting web is carried out on the immovable support.

When as described hereinabove the connecting web is provided between the edges facing toward the central workpiece support, it is advantageous to arrange the separating device or devices on an embodiment of the cutting press described in the above mentioned application so that above the central workpiece support and the discharge opening at least one raisable and lowerable press-out device is provided with a pressing plate having pressing-out elements at its lower side. It is advantageous in accordance with the present invention to conduct the separation of the connecting web so that on the pressing plate at its side facing away from the cutting tool of the cutting press the special separating device is arranged with its separating die extending through the pressing plate and a matrix associated with the separating die and arranged in a supporting member of the central workpiece support, located with a closed discharge opening under the separating die. Here the pressing plate is used as a carrier for the separating device or devices, and the required matrix can be arranged in the central workpiece support in the provided supporting member. In this embodiment the workpiece plates or sheets with greater thickness, or of materials with higher strength, can be worked since here a complete separating tool including a die and a matrix is provided.

Drive means for the separating device or separating devices can be formed as a pressure-medium-actuated cylinder-piston unit which is particularly suitable for remaining machine cycle and can be associated with other machine controls. In the case of the above mentioned embodiment, it is advantageous when, in accordance with a further feature of the present invention, the separating device has a cylinder-piston unit arranged on the pressing plate and connectable with the separating die.

It is advantageous when a minimum small pressing forces are applied by the respective separating devices, since the movable support on the tool operating region on the one hand and the supporting elements of the central workpiece support on the other hand can take only small reaction forces. It is thus advantageous when the separating tool of the separating device or separating devices is designed especially for these purposes. In accordance with the present invention it is proposed to provide the separating die of the separating device with a blade which is inclined in the longitudinal direction of the connecting web and relative to a horizontal, so that its cutting edge facing toward the edge of the workpiece part first engages the connecting web. With this construction, first a first connecting point of the respective connecting web is separated or cut out by the cutting edge before this cutting edge engages further. As a result of this, materials with greater thicknesses or materials with greater strengths such as chromium-nickel-steel with higher strengths and higher ductility can be worked without difficulties.

To further improve the cutting functions in this sense it is proposed, in accordance with still a further feature of the present invention, to incline both cutting edges additionally transverse to the longitudinal direction of the connecting web. Therefore, a shearing incline is provided which facilitates and improves the cutting step. For reliably absorbing the lateral forces, the die in accordance with a still additional feature of the present invention is provided at the ends of its cutting edges with guide projections which are associated with respective insertion roundings in the matrix. These guide projections or catching projections perform also additional directing functions and deflect the produced lateral forces in the matrix.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
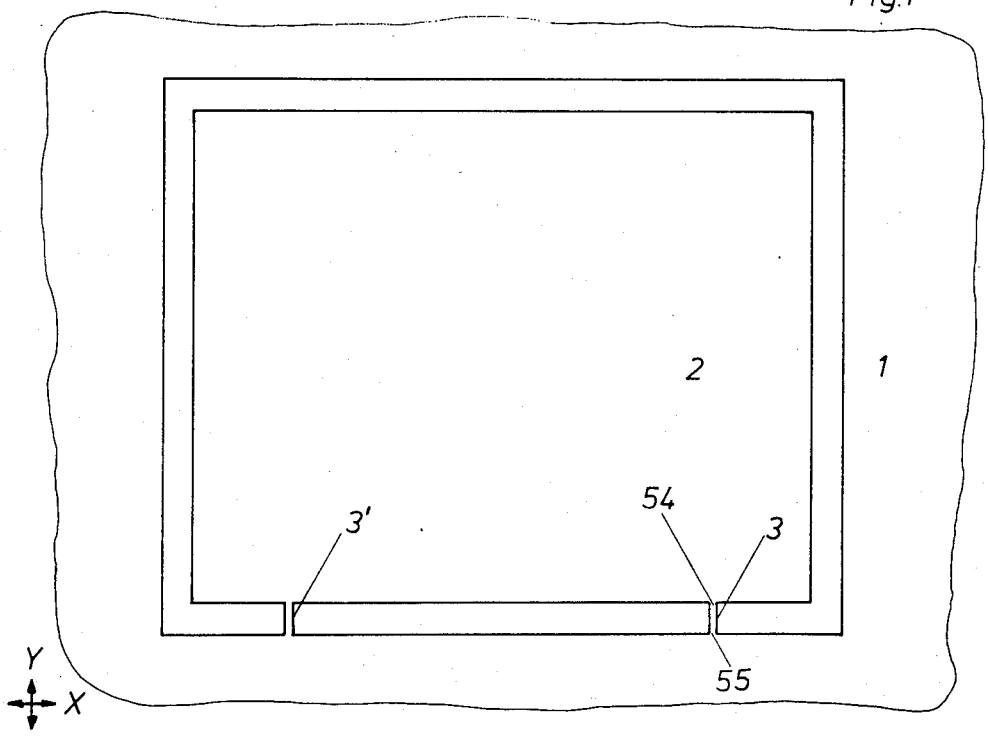
FIGS. 1 and 2 are views showing two examples of partial separation of a workpiece part from a workpiece plate with retention of connecting webs.
Figure 2:
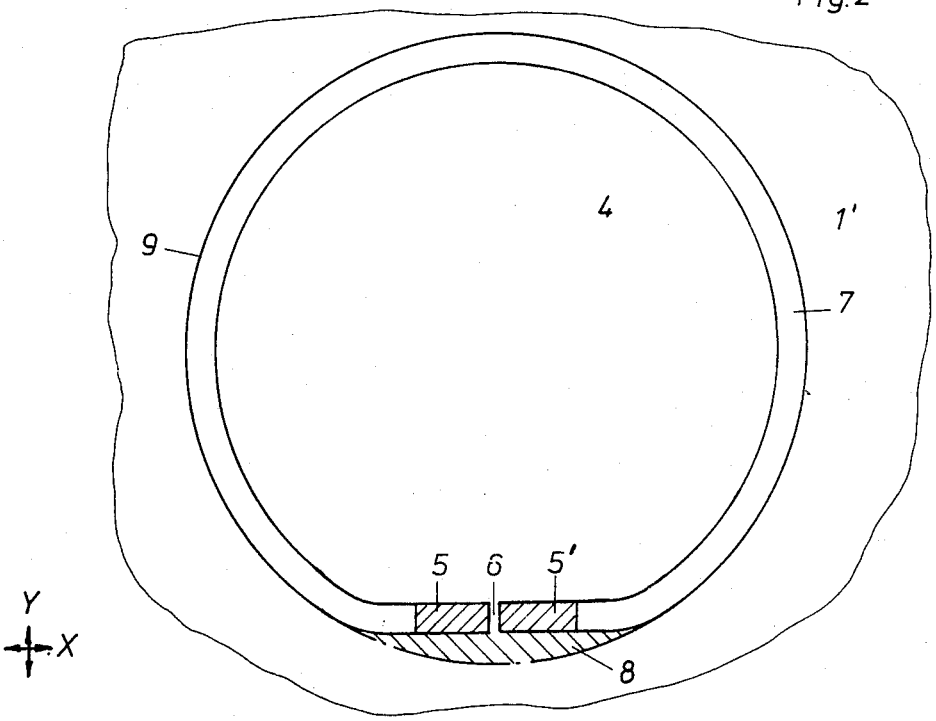

The principle of the method in accordance with the present invention is illustrated in FIGS. 1 and 2. From a workpiece plate 1 a workpiece part 2 must be separated. As shown first in FIG. 1, the workpiece part to be separated is first separated with the aid of the respective cutting tool, which will be described later on, so as to retain two connecting webs 3 and 3' between the separating edges of the workpiece plate and workpiece part, the separating edges extending transverse to the movement direction (y-axis direction) of the central workpiece support. The connecting webs 3 and 3' are separated from the workpiece part 2 after positioning of the workpiece plate and workpiece part by a coordinate table above a discharge opening and before its opening by operation of the central workpiece support. It is to be understood that in the event of displacement of the workpiece plate 1, the workpiece part 2 is taken along safer via the connecting webs 3 and 3'. Both connecting webs 3 and 3' provided in FIG. 1 are advantageous for workpiece parts with great dimensions. For workpiece parts of small dimensions, one connecting web can be sufficient.

FIG. 2 shows the principle of the inventive method for a round workpiece part 4 to be separated from a workpiece plate 1'. For preparation of the inventive method, first two punctures 5 and 5' are punched by a rectangular punch provided on a revolving cutting press in a tool station. The punctures 5 and 5' are identified with hatching in FIG. 2. A small connecting web 6 is retained between both punctures 5 and 5' and located between the separating edges of the workpiece plate 1 and workpiece part 4, the edges located transverse to the movement direction of the central workpiece support. Then with the aid of for example a nibble or another suitable tool a contour 7 is cut out in the tool station of the revolving cutting press, so that the workpiece part 4 remains connected with the workpiece plate 1' only by the connecting web 6. When then the workpiece plate and the workpiece part are placed by the coordinate table of the cutting press above the discharge opening, the connecting web 6 is removed before opening of the discharge opening by operation of the central workpiece support, so that the workpiece part can be discharged through the discharge opening. Subsequently, in the tool station a remaining piece 8 which is identified by hatching is separated by a further suitable separation step, for example by nibbling, so that the desired complete circular puncture 9 in the workpiece plate 1 is produced.

The method in accordance with the present invention is further explained in connection with the operation of the suitable revolving cutting press.

Figure 3:
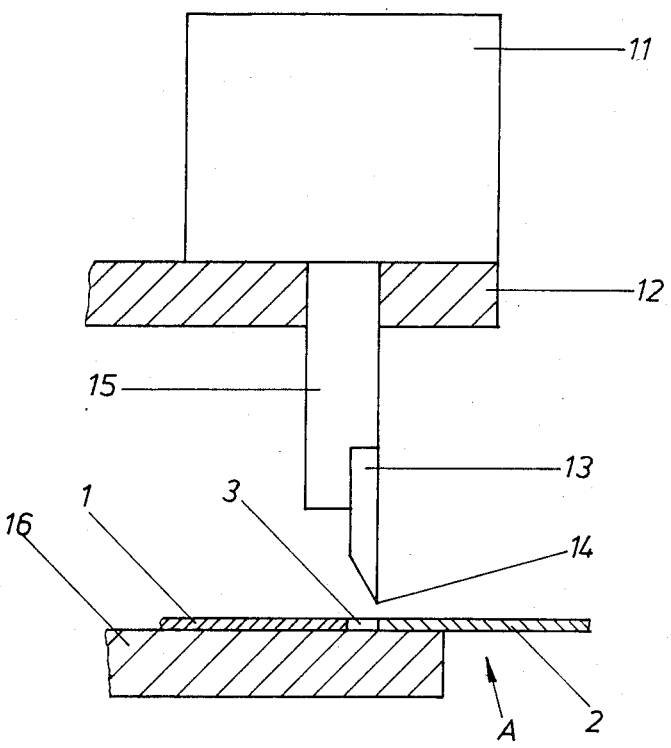
FIG. 3 is a schematic partially sectioned lateral view of a separating device in accordance with one embodiment of the invention.
Figure 3A:
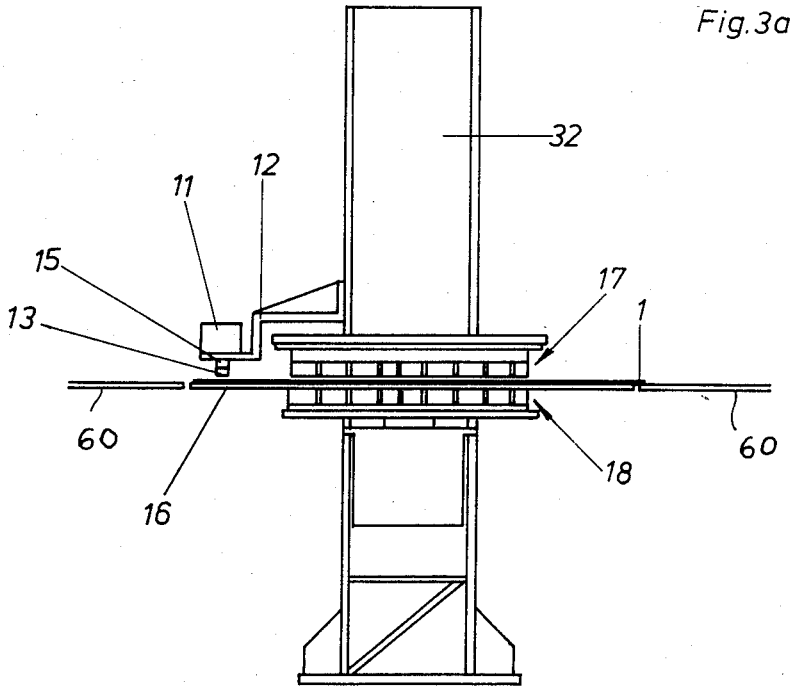
FIG. 3*a* is a schematic front view of a revolving cutting press with the separating device of FIG. 3.
Figure 4:
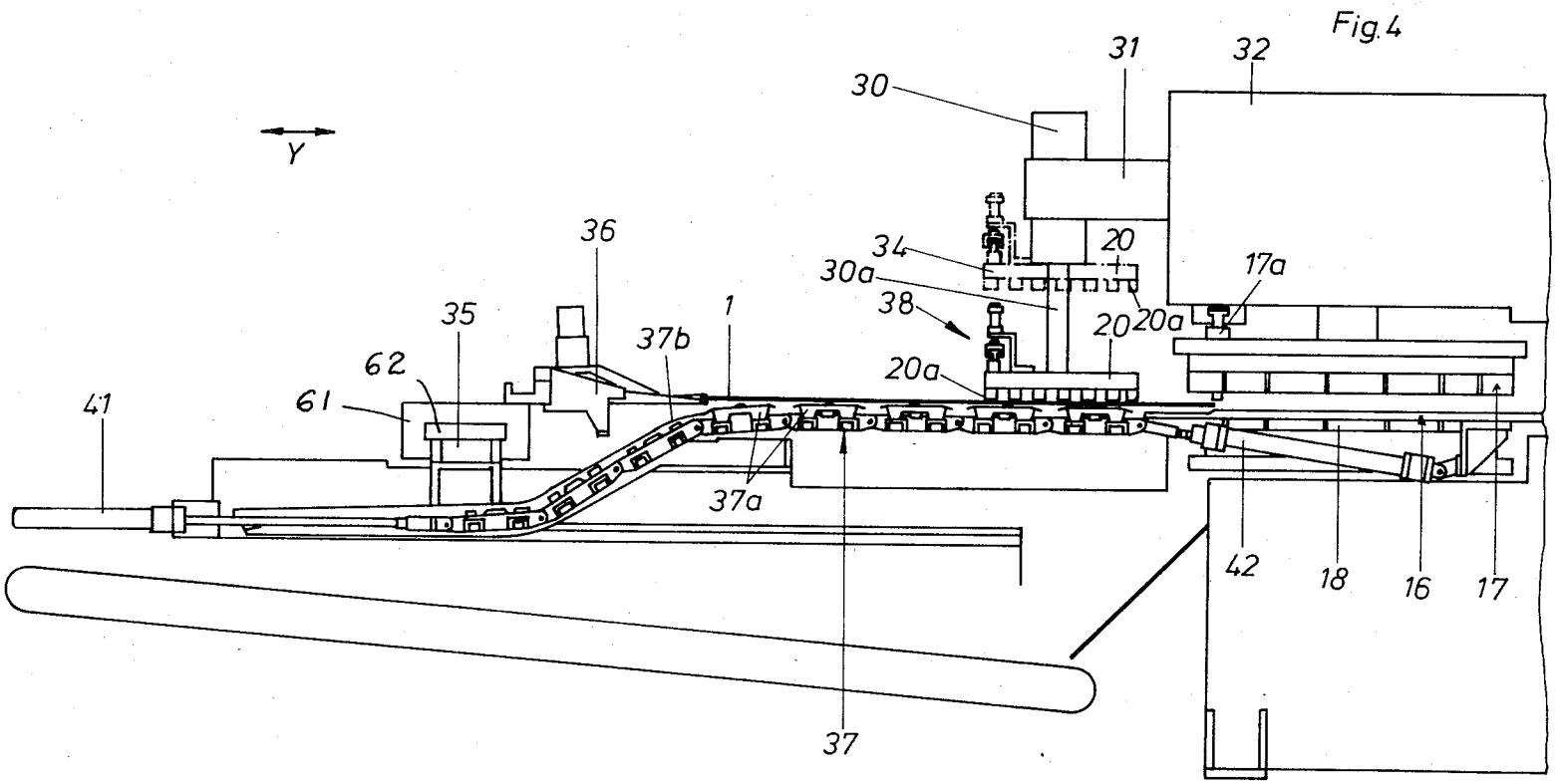
FIG. 4 is a schematic lateral view of a revolving cutting press of the above described type with a separating device for the cutting web, formed in accordance with a second embodiment of the present invention.

The separating of the connecting web 3 and 3' or 6 can be performed in various ways. For thin workpiece plates with not always high strength it is possible to remove the connecting web or the connecting web 3 and 3' or 6 by a chisel-like tool which is actuated by a pressure-medium-operated drive. FIGS. 3 and 3*a* schematicaly show the respective embodiment of the cutting press. The separating device can be formed as a cylinder-piston unit 11 mounted on a holder 12 which is arranged on a machine part 32 located above the tool operating region and above a fixed support 16 located between two lateral workpiece supports and surrounding the tool operating region. FIG. 3 shows in detail the arrangement of the separating region. A separating element 13 with a chisel-like blade 14 is arranged on a piston rod 15 of the unit 11. The reaction force of this separating device is absorbed, as clearly shown in FIG. 3, by the support 16 which surrounds a lower revolving plate or turret 18 (tool magazine) of the cutting press. As shown in FIG. 3*a*, the separating device 11, 13, 14, 15 with its holder 12 is arranged near an upper revolving plate or turret 17 (tool magazine) of the tool operating region of the cutting press. From FIG. 3 it is also to be seen that, after the separation of the connecting web 3, the released workpiece part 2 can be discharged through the discharge opening identified with reference character A, when the central workpiece support releases the discharge opening. With the utilization of this embodiment the connecting webs 3, 3' or 6 are arranged between the edges of the workpiece part 2 or 4 and the workpiece plate 1 or 1', the edges directed toward the support 16.

FIGS. 4–7 schematically show another embodiment of the cutting press in accordance with the present invention which is used first to provide that during displacement of the workpiece plate with the workpiece part retained thereon the workpiece part must be pulled exclusively by the connecting webs to prevent any displacement of the workpiece part and the workpiece plate relative to one another.

The principle construction of the cutting press shown here is disclosed in the description and drawing of the above application Ser. No. 405,336, now U.S. Pat. No. 4,452,115. The cutting press has the stationary support 16 which surrounds the operating region of the tool, here the tool arranged on the upper revolving plate 17 and the lower revolving plate 18. A control coordinate table for workpiece positioning is identified as a whole with reference numeral 35. The cordinate table 35 has two transverse carriages which are not shown and identified here. The transverse carriages are moveable parallel to the y-axis and have lateral working supports which form the space for the support 16, as well as a guide rail 62 connecting the same with clamping elements 36 for the workpiece plate 1 on a transverse carriage 61 displaceable transversely in the direction of the x-axis. A central workpiece support is located before the support 16 between the lateral workpiece supports and identified with reference numeral 37. It is composed of supporting members 37*a* which are articulately connected with one another. The supporting members 37*a* are supported and movablely guided in lateral guiding paths 37*b* arranged on the lateral workpiece support and displaceable together with the latter. The guide paths 37*b* are arranged in the region of the clamping element 36 of the transverse carriage to form a downwardly extending path. The supporting members 37*a* are displaceable relative to the immovable support 16 by pulling elements 41 and 42 formed advantageously as pressure-medium-operated cylinder-piston units, in direction of the y-axis. They are displaceable from the immovable support 16 for such a distance that between the support 16 and the first supporting elements facing toward the same a discharge opening A (FIG. 7) for the separated part 2 of the previously moved back workpiece plate 1 is opened or closed by the respective return movement of the supporting members 37*a* of the central workpiece support.

Figure 5:
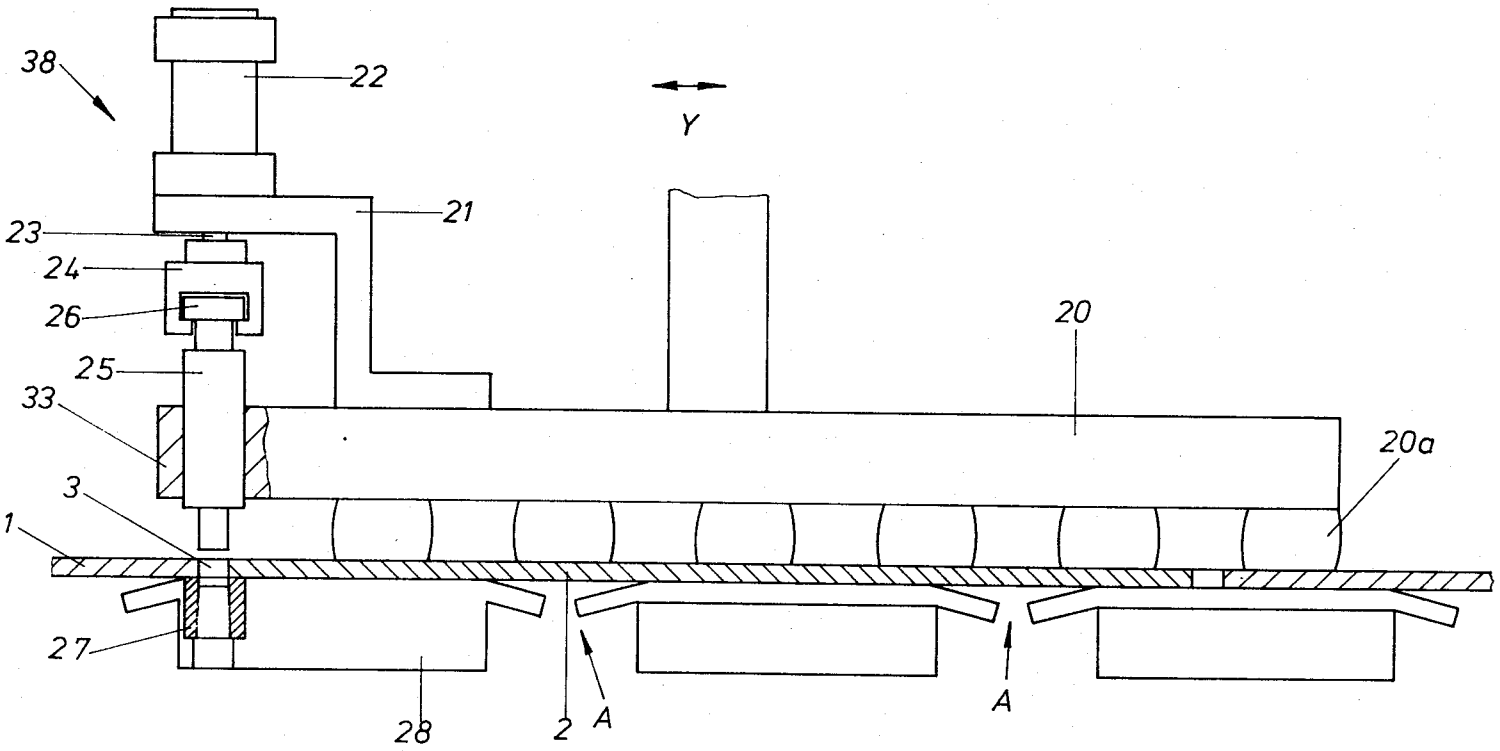
FIGS. 5 and 6 are partially sectioned lateral views of the separating device of the revolving cutting press of FIG. 4 with a lowered pressing plate prior to the actuation of the separating device and after the actuation of the separating device, respectively.
Figure 6:
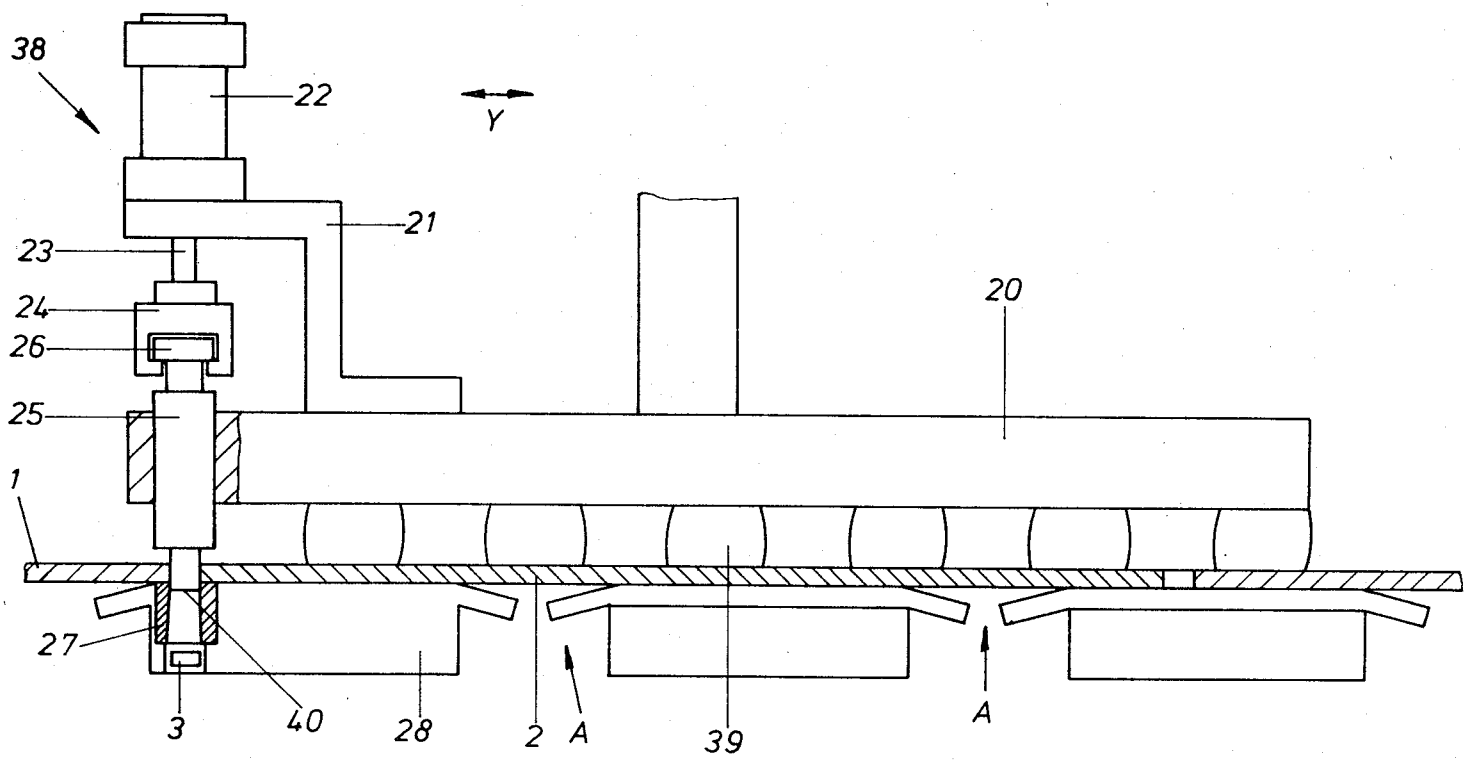

Further, as described in the application Ser. No. 405,336, now U.S. Pat. No. 4,452,115, a lowerable and liftable pressing-out device is arranged above the central workpiece supports 37 and the discharge opening A on a holder 31 of the machine body 32. This pressing-out device has a cylinder-piston unit 30 with a piston rod 30*a* which carries a pressing plate 20 with pressing-out elements 20*a* arranged at its lower side. In accordance with the invention, the pressing plate 20 at its side facing away from the tool operating region of the associated cutting tool 17*a* of the cutting plate, carries a separating device identified as a whole with reference numeral 38. For this purpose the pressing plate 20 carries on its upper side with the aid of an angular holder 21 a cylinder-piston unit 22 for driving the separating device 38. A piston rod 23 of the unit 22 is provided with a claw coupling 24. This claw coupling 24 engages a coupling pin 26 of a separating die 25 which extends through a part 33 of the pressing plate 20 and is guided in it. A matrix 27 is associated with the separating die and arranged in a supoorting member 28 of the central workpiece support 37. With the closed discharge opening A the supporting member 28 of the central workpiece support 37 having the matrix 27 is located under the separating die 25. FIGS. 5 and 6 show the details of this arrangement on an enlarged scale.

Figure 7:
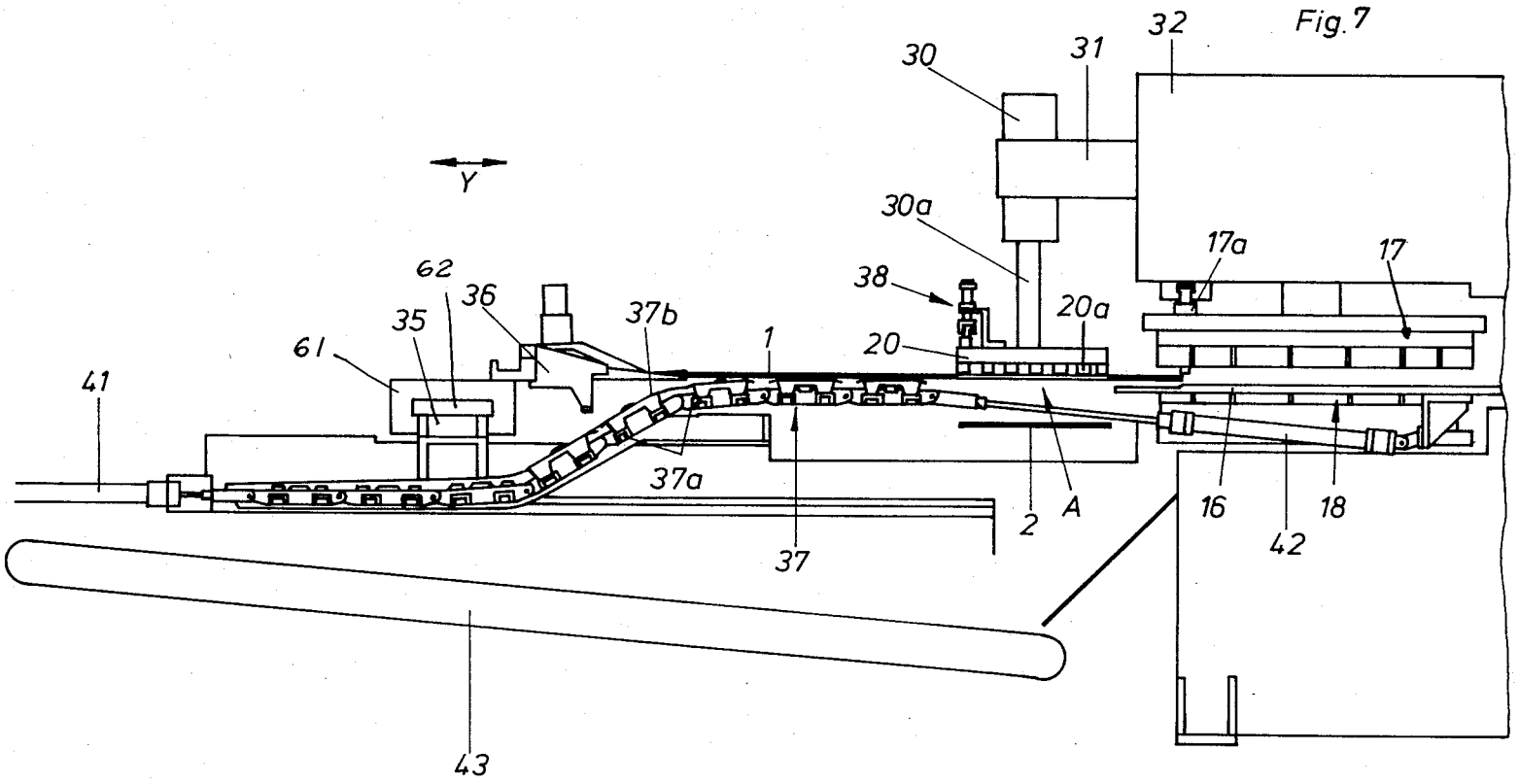
FIG. 7 is a view of the revolving cutting press in correspondence with FIG. 4 after termination of the respective separating step and opening of a discharge opening by displacing of a central workpiece support.

The cutting press shown in FIGS. 4–7 with the arrangement in accordance with the present invention operates as follows: In normal cutting or punching operation of the revolving cutting press, the pressing plate 20 is located in its raised position 34 shown in dash-dot lines. After termination of the cutting step in the tool operating region of the revolving cutter press, the workpiece plate 1 with the workpiece part 2 or 4 which is cut out with the exception of the connecting webs 3, 3' or 6 is so positioned on the central workpiece support 37 that the respective connecting webs 3, 3' or 6 is located exactly above the matrix 27 in the supporting member 28 of the central workpiece support 37. This positioning is performed with the aid of the coordinate table 35, namely via the clamping element 36. By actuation of the cylinder-piston unit 30 the pressing plate 20 with the separating device 38 arranged thereon is lowered, so that the pressing-out elements 20*a* press against the workpiece part 2 or 4. This position is shown in FIG. 5. By actuation of the cylinder-piston unit 22 the respective connecting webs 3, 3' or 6 is removed by the blade 40 whose position is shown in FIG. 6. After withdrawal of the plunger 25 in the position of FIG. 5, the central workpiece support is displaced in a manner described in the application Ser. No. 405,336, now U.S. Pat. No. 4,452,115, by respective actuation of the pulling elements 41 and 42 so that as shown in FIG. 7 the discharge opening A is opened and the completely cut out workpiece part 2 or 4 can fall downwardly to a conveyor band 43 to be transported.

From the above presented description of the inventive method and cutting press, it is believed to be clear that, depending on the number of the connecting webs, one or several separating stations 11–15 or 38 can be arranged on the cutting press in a prefixed distance. In the event of greater parts with at least two or more connecting webs for temporarily holding the workpiece part as shown in FIG. 1, all connecting webs can be separated in a positioned location of the coordinate table simultaneously. However, a control is provided for individually actuating the respective separating station, so that the same machine can be used for smaller parts as shown in FIG. 2 for separating only one connecting web. It is clear that the respective positioning of the workpiece plate with the workpiece parts can be exactly controlled and conducted by the coordinate table.

FIGS. 8, 8*a*, 9 and 9*a* show advantageous embodiments of the separating element or separating plungers with the associated matrix, of the separating device 38. These embodiments are selected so as to provide a minimum possible pressing force during the separating step and thereby to retain the respective reaction force as low as possible. For this purpose the blade or its cutting edges of the plunger 25 in accordance with the present invention have a special shape. With this shape it shall be provided that with the aid of the respective shape of the cutting edges connecting webs can be separated in which either the material thickness is great or the material strength, since in such a revolving cutting press with coordinate table, frequently non-rusting materials, for example chromium-nickel-steel with high strength and high ductility are worked.

Figure 8A:
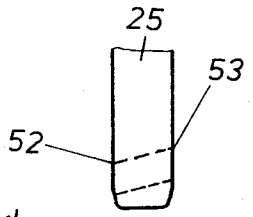
FIGS. 8 and 8*a* are side views turned by 90° and showing the lower end of a separating element of the separating device of FIGS. 5 and 6.
Figure 8:
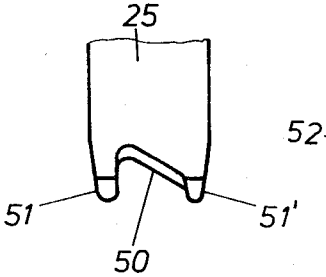

The shape of the cutting edges in accordance with the present invention is shown in FIGS. 8 and 8*a*. The blade 50 of the separating plunger 25 of the separating device 38 is inclined in the longitudinal direction of the connecting web to be separated and relative to the horizontal so that, a connecting point 54 of the connecting web 33 is first is separated or cut by a cutting edge 52 (FIG. 8*a*), before a cutting edge 53 (FIG. 8*a*) engages a connecting point 55. As can be further seen from FIG. 7 the blade 50 is further designed such that both cutting edges 52 and 57 are additionally inclined transverse to the longitudinal direction of the connecting web 3 in FIG. 1 in the shape of a shear incline. Thereby the cutting force is further reduced.

Figure 9:
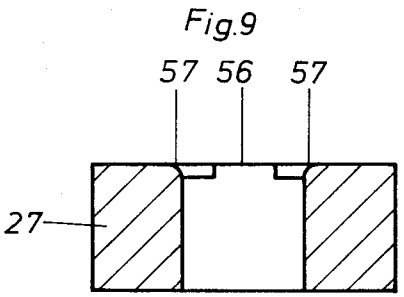
FIGS. 9 and 9*a* are a longitudinal view and a plan view of the associated matrix.
Figure 9A:
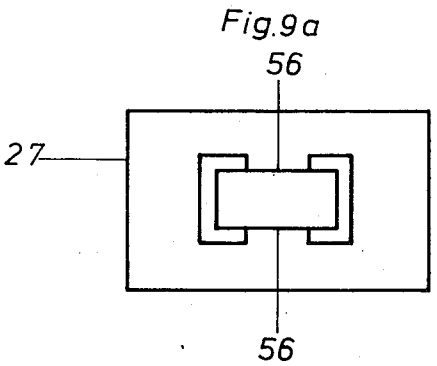

Since with such a design and arrangement of the blade additional lateral forces are produced, the plunger at the ends of the cutting edges 52 and 53 or the blade 50 is provided with guiding projections 51 and 51' (catching projections). The projections 51, 51' are both first sinked into the matrix 27 before the separating process begins on the connecting webs. There guiding projections 51 or 51' are formed so that they can assume additional directing functions relative to the matrix 27 and also withdraw additional lateral forces in the matrix 27. As shown in FIGS. 9 and 9*a*, the matrix 27 is sharply ground only in its central part 56, whereas the remaining region is provided with a rounding 57 for facilitating insertion of the guiding projections 51, 51' of the plunger 25.

It will be understood that each of the elements described above, or two or more together, may also find a useful apolication in other types of constructions differing from the types described above.

While the invention has been illustrated and described as embodied in a method of and an arrangement for separating a workpiece part from a workpiece plate, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of separating a workpiece part from a workpiece plate in a cutting press with an immovable support in an operating region of a tool, with a controlled coordinate table for a workpiece positioning and having two lateral workpiece supports movable parallel to the y-axis and defining a space for the immovable support as well as a guide rail connecting said lateral workpiece supports and provided with a transverse carriage movable in the direction of the x-axis and carrying clamping means for the workpiece plate, and with a central workpiece support located between the lateral workpiece supports before the immovable support and composed of a plurality of supporting elements displaceable in the direction of the y-axis from the immovable support so that a discharge opening is formed between the immovable support and a first supporting element facing thereto and openable for discharging the separated workpiece part of the previously withdrawn workpiece part or closable by return movement of the supporting elements the method comprising the steps of separating a respective workpiece part with the aid of a cutting tool so as to retain at least one connecting web between separating edges of the workpiece plate and the workpiece part, the edges extending transverse to the direction of movement of the central workpiece support; positioning the workpiece plate and the workpiece part by the coordinate table above the discharge opening; and removing the connecting web after said positioning and before opening of the discharge opening, by displacing the central workpiece support from the workpiece part.

2. A method as defined in claim 1, wherein said separating step includes separating the workpiece part from the workpiece plate so that the connecting web is retained between those edges of the workpiece plate and the workpiece part, which face toward the central workpiece support.

3. A cutting press for separating a workpiece part from a workpiece plate, comprising an immovable support surrounding an operating region of a tool; a control coordinate table for a workpiece positioning and including two lateral workpiece supports movable in the direction of the y-axis and providing a space therebetween for said immovable support as well as a guiding rail with a transverse carriage movable in the direction of the x-axis and carrying clamping means for a workpiece plate; a central workpiece support located between said lateral workpiece supports before said immovable supports and including a plurality of articulately connected supporting elements displaceable in the direction of the y-axis from said immovable support so that a discharge opening is formed and openable and closable between said immovable support and a first supporting element facing thereto for discharging the separated workpiece part and openable for discharging the separated workpiece part of the previously withdrawn workpiece plate or closable by return movement of the supporting elements; a cutting tool for cutting the workpiece part from the workpiece plate so as to retain at least one connecting web between separating edges of the workpiece tool and workpiece plate, the separating edges extending transverse to the direction of movement of said central workpiece support; and a separating device operative for separating the connecting web after the positioning of the workpiece plate and the workpiece part by the coordinate table above said discharge opening and before opening of said discharge opening.

4. A cutting oress as defined in claim 3, wherein said immovable support surrounds the tool operating region; and further comprising a machine part located above the tool operating region, said separating device being arranged on said machine part and above said immovable support and has a separating element separating the connecting web and arranged so that said immovable support forms a countersupport for said separating element.

5. A cutting press as defined claim 3; and further comprising at least one raisable and lowerable pressing-out device located above said central workpiece support and said discharge opening and provided with a pressing plate with pressing-out elements at its lower side, said separating device being arranged on said pressing plate at each side facing away from said cutting tool and having a separating die extending through said pressing plate and a matrix associated with said separating die, said matrix being arranged in said central support and located under said separating die when said discharge opening is closed.

6. A cutting press as defined in claim 5, wherein said separating device has a cylinder-piston unit arranged on said pressing plate and connectable with said separating die.

7. A cutting press as defined in claim 6, wherein said separating die of said separating device has a blade which is inclined in a longitudinal direction of the connecting web and relative to a horizontal plane so that its cutting edge which faces toward an edge of the workpiece part engages first the connecting web.

8. A cutting press as defined in claim 7, wherein said blade of said separating die of said separating device has a second cuting edge, said cutting edges being additionally inclined transverse to the longitudinal direction of the connecting web.

9. A cutting press as defined in claim 8, wherein said cutting edges of said blade of said separating die have ends provided with guide projectiqns, said matrix having insertion roundings with which said guide projections are associated.

* * * * *